US005339967A

United States Patent [19]

Valiulis

[11] Patent Number: 5,339,967

[45] Date of Patent: Aug. 23, 1994

[54] STRIP MERCHANDISER

[75] Inventor: Stanley C. Valiulis, Rockford, Ill.

[73] Assignee: Southern Imperial, Inc., Rockford, Ill.

[21] Appl. No.: 93,479

[22] Filed: Jul. 19, 1993

[51] Int. Cl.[5] ..... A47F 5/00

[52] U.S. Cl. ..... 211/57.1; 211/73; 211/113; 248/220.2; 248/220.4

[58] Field of Search ..... 211/59.1, 57.1, 113, 211/86, 71, 73; 248/220.2, 220.3, 220.4, 224.4

[56] References Cited

U.S. PATENT DOCUMENTS 4,497,464 2/1985 Fast ..... 211/113 X
4,572,380 2/1986 Langwell ..... 211/57.1
4,713,899 12/1987 Fast ..... 211/57.1 X
4,832,207 5/1989 Alexander ..... 211/57.1
4,911,392 3/1990 Fast ..... 211/113 X
5,284,259 2/1994 Conway et al. ..... 211/113 X

*Primary Examiner*—Robert W. Gibson, Jr.
*Attorney, Agent, or Firm*—Leydig, Voit & Mayer

[57] ABSTRACT

A strip merchandiser with a horizontal mounting portion adapted to overlie a shelf in order to suspend an item-supporting portion vertically in front of the shelf. Two transversely spaced anchors project downwardly from the mounting portion and interlock releasably with two transversely spaced holes in the shelf to provide a secure and stable attachment of the merchandiser to the shelf. A pair of wings folded inwardly from the mounting portion engages the front of the shelf to hold the item-supporting portion of the merchandiser in forwardly spaced relation from the shelf.

7 Claims, 2 Drawing Sheets

STRIP MERCHANDISER

BACKGROUND OF THE INVENTION

This invention relates to a strip merchandising device and, more particularly, to a device of the same general type as disclosed in Fast U.S. Pat. No. 4,546,943. That device includes an elongated plastic strip having a mounting portion and an item-supporting portion subdivided by a transversely extending fold line which permits the mounting portion to be disposed horizontally on an apertured display shelf with the item-supporting portion suspended vertically from the shelf.

In the strip merchandiser of the Fast patent, an anchor which is generally in the form of an arrowhead projects from a transversely extending edge of the mounting portion and is adapted to be inserted into and interlocked releasably with one of the holes in the shelf. The single-point anchor can pull out of the hole if the strip is loaded with heavy merchandise and, in addition, the strip has a tendency to tilt transversely if the weight of the merchandise is off-center with respect to the strip.

SUMMARY OF THE INVENTION

The general aim of the present invention is to provide a new and improved strip merchandiser which is adapted to be more securely and stably attached to the shelf than prior devices of the same general type so to enable the merchandiser to support heavier loads and to hang vertically even if the load is off balance.

A more detailed object of the invention is to achieve the foregoing by providing a merchandiser in which the mounting portion includes two transversely spaced anchors adapted to extend downwardly into and releasably interlock with two transversely spaced holes in the shelf.

The invention also resides in the unique construction and shape of the anchors to enable the anchors to be folded downwardly from the mounting portion of the merchandiser and to interlock snugly with the holes.

A further object of the invention is to provide a merchandiser having novel side wings adapted to be folded from the mounting portion of the merchandiser and adapted to engage the front edge of the shelf to keep the item-supporting portion of the merchandiser spaced forwardly from the shelf.

These and other objects and advantages of the invention will become more apparent from the following detailed description when taken in conjunction with the accompanying drawings.

DETAILED DESCRIPTION OF THE PREFERRED EMBODIMENT

Figure 1:
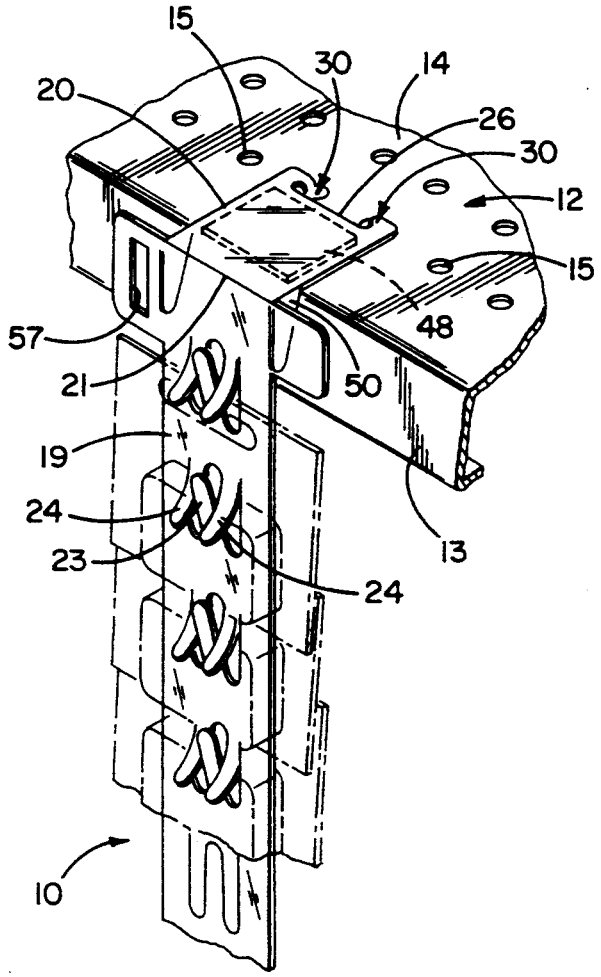
FIG. 1 is a fragmentary perspective view of a typical shelf equipped with a new and improved strip merchandiser incorporating the unique features of the present invention.
Figure 2:
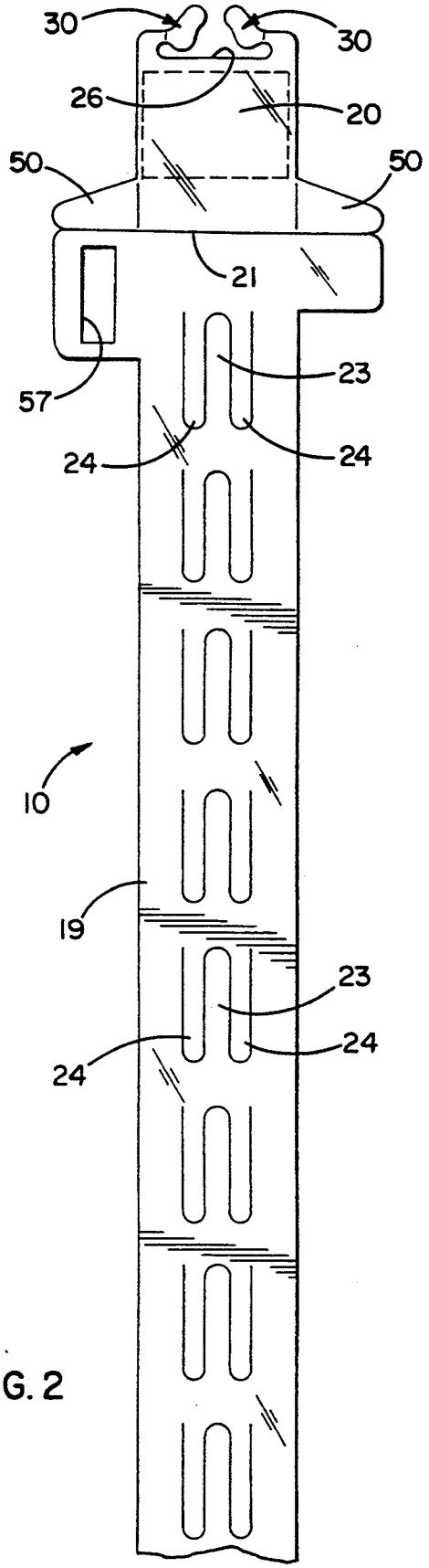
FIG. 2 is an enlarged front elevational view showing the merchandiser as initially formed and prior to being folded for attachment to the shelf.

For purposes of illustration, the invention has been shown in the drawings as embodied in a strip merchandiser 10 which is particularly suited for displaying merchandise in front of a horizontal shelf 12 having a front edge 13 and having a horizontal surface 14 which is formed with at least one transversely extending row of transversely spaced and vertically extending holes 15, the spacing between adjacent holes typically being one inch. The front edge 13 of the shelf herein has been shown as lying in a vertical plane but it will be appreciated that the edge could be shaped as shown in Fast U.S. Pat. No. 4,483,502 and Fast U.S. Pat. No. 4,718,627.

In many respects, the strip merchandiser 10 is similar to that disclosed in the Fast '627 and '943 patents. Thus, the merchandiser is formed from an initially flat and planar single-piece plastic strip which may be stamped from sheet stock. The strip includes an elongated item-supporting portion 19 and a significantly shorter mounting portion 20 subdivided by a transversely extending score line 21 which permits the mounting portion to be folded at right angles to the item-supporting portion so that the mounting portion may be placed against the upper surface 14 of the shelf 12 with the item-supporting portion suspended vertically in front of the front edge 13 of the shelf. The item-supporting portion 19 is formed with a series of vertically spaced slits each in the form of an elongated W and each defining a central upwardly extending product suspension hook 23 and a pair of outer stabilizing fingers 24.

The mounting portion 20 includes a flat body having a width approximately equal to that of the major length of the item-supporting portion 19 and having a transversely extending edge 26 disposed parallel to the score line 21. In accordance with the present invention, two transversely spaced anchors 30 project from the body of the mounting portion 20 adjacent the free edge 26 thereof and are adapted to be inserted downwardly into releasable interlocking relation into two holes 15 in the shelf 12. As a result of the merchandiser 10 being securely attached to the shelf by two transversely spaced anchors 30 which interlock with two transversely spaced holes 15, the merchandiser can support more weight and, in addition, if the weight of the product is offset with respect to the vertical centerline of the item-supporting portion 19, the merchandiser is held against tilting.

More specifically, each anchor 30 is a flat member shaped generally as a foot having a convexly rounded toe 31 (FIG. 3), a convexly rounded heel 33, and a concavely curved arch 35 extending between the toe and the heel. The edge 37 of the anchor opposite the arch 35 is also concavely curved. A short leg 39 adjacent the heel 33 and the edge 37 joins the anchor to a tab 41 which projects from the transversely extending edge 26 of the mounting portion 20 adjacent the side edge 43 thereof, the tab being perpendicular to both the edge 26 and the leg 39.

As initially formed, the anchors 30 and the tabs 41 lie in the same plane as the mounting portion 20. As shown most clearly in FIG. 3, score lines 45 are located between the tabs 41 and the legs 39 of the anchors and extend perpendicular to the transversely extending score line 21 and the transversely extending edge 26. As a result, the anchors may be folded downwardly at right angles to the tabs 41 along the score lines 45 and, when so folded, the anchors are spaced transversely from one another by a distance of about one inch. By virtue thereof, the anchors may be inserted downwardly into two adjacent holes 15 in the shelf 12 and, due to the shape of the anchors, they releasably interlock with the edges of the holes to secure the merchandiser 10 in place. Because the two anchors 30 suspend the item-supporting portion 19 of the merchandiser from two transversely spaced locations, heavier merchandise may be hung on and displayed from the merchandiser without the mounting portion 20 pulling away from the shelf. If the weight of the merchandise is off-center, the two anchor locations help prevent the merchandiser from canting from a vertical position.

Optionally, a coacting of pressure-sensitive adhesive 48 may be applied to the lower side of a section of the mounting portion 20, the adhesive initially being protected by a peel-away backing (not shown). If incorporated into the merchandiser 10, the pressure-sensitive adhesive adheres to the upper surface 14 of the shelf 12 and further increases the load-carrying capability of the merchandiser 10.

Advantageously, two generally V-shaped and initially transversely extending wings 50 are integral with the side edges of the mounting portion 20 at the end thereof remote from the anchors 30. The wings are joined to the mounting portion by score lines 51 (FIG. 3) extending parallel to the score lines 45 and are separated from a transversely widened section 53 of the item-supporting portion 19 by transversely extending slits 54. By folding the wings 50 downwardly about the score lines 51, the wings may be positioned to engage the front edge 13 of the shelf 12 and hold the item-supporting section 19 in forwardly spaced relation from the shelf. The wings are particularly advantageous if the front edge 13 of the shelf is of irregular shape or is not perpendicular to the top surface 14 of the shelf. In some cases, the wings will not be used and, if desired, can be left in the same plane as the mounting portion 20 so that adjacent merchandisers 10 can be staggered relative to one another.

Figure 3:
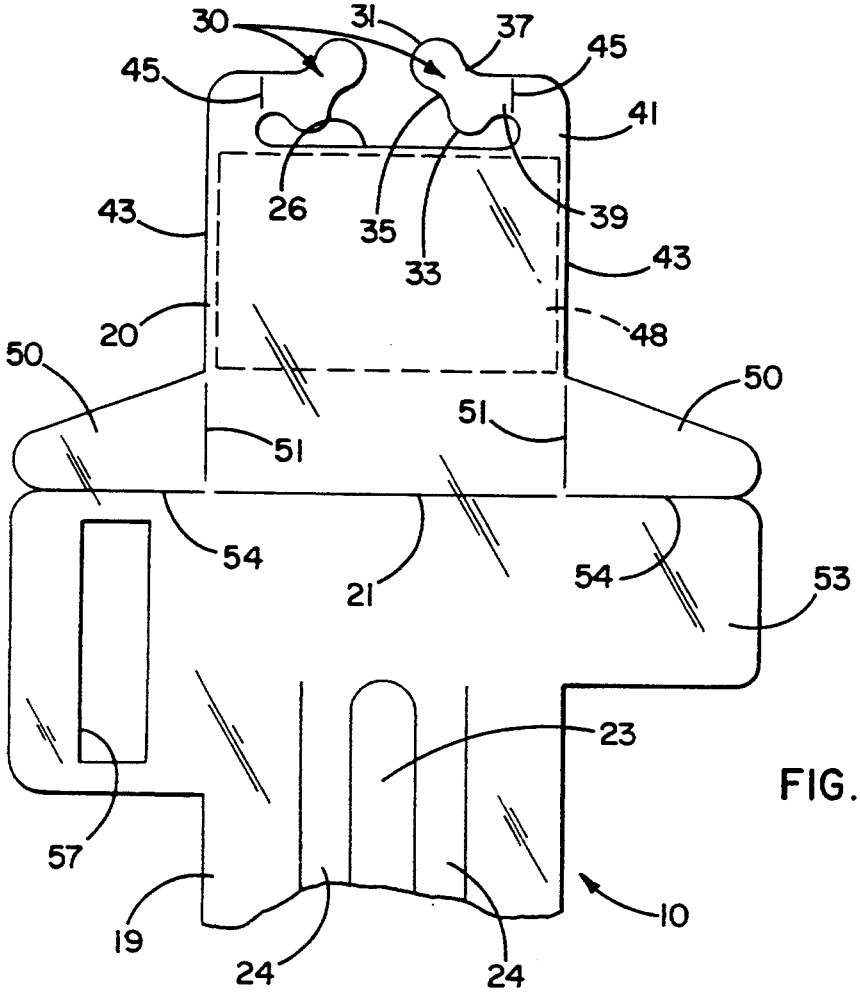
FIG. 3 is an enlarged fragmentary view of the upper end portion of the merchandiser shown in FIG. 2.
Figure 4:
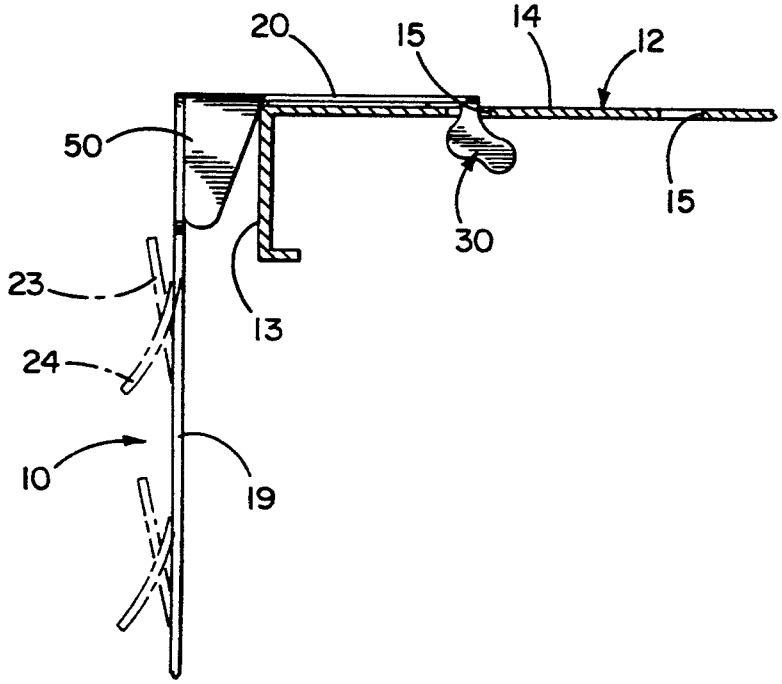
FIG. 4 is a side elevational view of the merchandiser illustrated in FIG. 1 with the shelf being broken away and shown in section.

As shown most clearly in FIG. 3, one side portion of the transversely widened upper section 53 of the item-supporting portion 19 is somewhat greater in length than the opposite side portion of the transversely widened section. A relatively long rectangular opening 57 is punched through the longer side portion and may be used to support a holder (not shown) for a forwardly projecting sign for indicating the nature of the articles on the merchandiser 10. The other side portion of the transversely widened section 53 may be used to support a pressure-sensitive price/inventory control label (not shown).

From the foregoing, it will be apparent that the present invention brings to the art a new and improved strip merchandiser 10 in which the two transversely spaced anchors 30 project downwardly through and interlock releasably with the holes 15 to provide a more secure and stable mounting for the merchandiser. The wings 50 space the item-supporting portion 19 away from the shelf 12 and enable adjacent merchandisers to be staggered.

I claim:

1. A device for suspending items forwardly of a generally horizontal display shelf having a plurality of transversely spaced and vertically extending holes formed therein, said device comprising an integrally formed elongated plastic strip subdivided into a mounting portion and an item-supporting portion by a transversely extending fold line extending entirely across the width of the strip to permit said mounting portion to be disposed horizontally on the shelf and said item-supporting portion to be suspended vertically from the shelf, said item-supporting portion including vertically spaced means for supporting items, said mounting portion having a transversely extending edge remote from said fold line, and first and second anchors integral with and depending from said mounting portion adjacent said edge and shaped to project downwardly into and releasably interlock with first and second ones of said holes thereby to secure said device to said shelf.

2. A device as defined in claim 1 in which each of said anchors is shaped generally as a foot having a convexly curved toe, having a convexly curved heel and having a concavely curved arch extending between said toe and said heel.

3. A device as defined in claim 2 in which each of said anchors includes an upright leg extending upwardly from the heel of the anchor.

4. A device as defined in claim 3 further including a tab integral with the upper end of the leg of each anchor and joined thereto by a horizontal fold line extending generally perpendicular to said transversely extending fold line, said tabs being disposed in the same plane as said mounting portion and projecting from said transversely extending edge of said mounting portion adjacent opposite side edges thereof.

5. A device as defined in claim 1 further including first and second transversely spaced tabs disposed in the same plane as said mounting portion and projecting from said transversely extending edge of said mounting portion adjacent opposite side edges thereof, said first and second anchors being joined to said first and second tabs, respectively, by horizontal fold lines extending generally perpendicular to said transversely extending edge.

6. A device as defined in claim 5 further including wings integral with and depending from opposite side edges of said mounting portion adjacent said transversely extending fold line, said wings being engageable with the forward edge of said shelf to space said item-supporting portion forwardly of said shelf.

7. A device as defined in claim 1 further including wings integral with and depending from opposite side edges of said mounting portion adjacent said transversely extending fold line, said wings being engageable with the forward edge of said shelf to space said item-supporting portion forwardly of said shelf.

* * * * *